United States Patent [19]

Kern

[11] 4,012,807

[45] Mar. 22, 1977

[54] VEHICLE BODY HOOD HINGE

[75] Inventor: Otto Andrew Kern, Lansing, Mich.

[73] Assignee: General Motors Corporation, Detroit, Mich.

[22] Filed: Oct. 6, 1975

[21] Appl. No.: 619,613

[52] U.S. Cl. ..... 16/128.1; 180/69 R

[51] Int. Cl.[2] ..... E05D 1/00

[58] Field of Search ..... 180/69 R, 69 C; 16/128.1, 128 R, 137; 296/76; 292/DIG. 39, 300, 304

[56] References Cited

UNITED STATES PATENTS

| | | | |
|---|---|---|---|
| 3,388,417 | 6/1968 | Upchurch | 16/128.1 |
| 3,815,176 | 6/1974 | Porter | 16/128.1 |

*Primary Examiner*—G. V. Larkin

*Attorney, Agent, or Firm*—John P. Moran

[57] ABSTRACT

A hinge for the rear end of a hood that selectively closes a vehicle body forward engine compartment opening, including interconnected body and hood hinge members movable into an interreceived relationship for the hood closed position, and a locking pawl pivotally mounted on the body hinge member such that forced rearward movement of the hood hinge member causes the locking pawl to pivot so as to engage an aperture formed in the hood hinge member, serving to diminish vertical and rearward movement of the hood during impact conditions and upon relaxation of the impact loads.

3 Claims, 4 Drawing Figures

VEHICLE BODY HOOD HINGE

This invention relates generally to a vehicle body hood hinge and, more particularly, to a hinge adapted to be used at the rear end of a hood for closing the access opening of a forward vehicle engine compartment.

Hood hinges have heretofore been designated with a view toward preventing vertical movement of the rear end of a forward engine compartment hood, should the vehicle bearing same be involved in a frontal impact with an obstacle. An example of such an arrangement is disclosed in U.S. Patent No. 3,815,176 issued in the name of Charles L. Parter.

Accordingly, an object of this invention is to provide an improved hood hinge including locking or latching means that help to limit any forced shifting of the rear end of the hood.

Another object of the invention is to provide an improved hood hinge including hood hinge and body hinge flanges with cooperating openings formed respectively therein for interreceiving the respective flanges, and having a locking pawl pivotally mounted on the body hinge flange and adapted to being pivoted into an aperture formed in the hood hinge flange upon experiencing a frontal impact with an obstacle, thereby supplementing the effectiveness of the inter-received flanges in preventing vertical and rearward movement of the hood hinge flange relative to the body hinge flange during such impact, as well as preventing rebounding of the hood hinge flange off the body hinge flange upon relaxation of the impact loads.

These and other objects and advantages of the invention will be apparent when reference is made to the following description and accompanying drawings, wherein.

Figure 1:
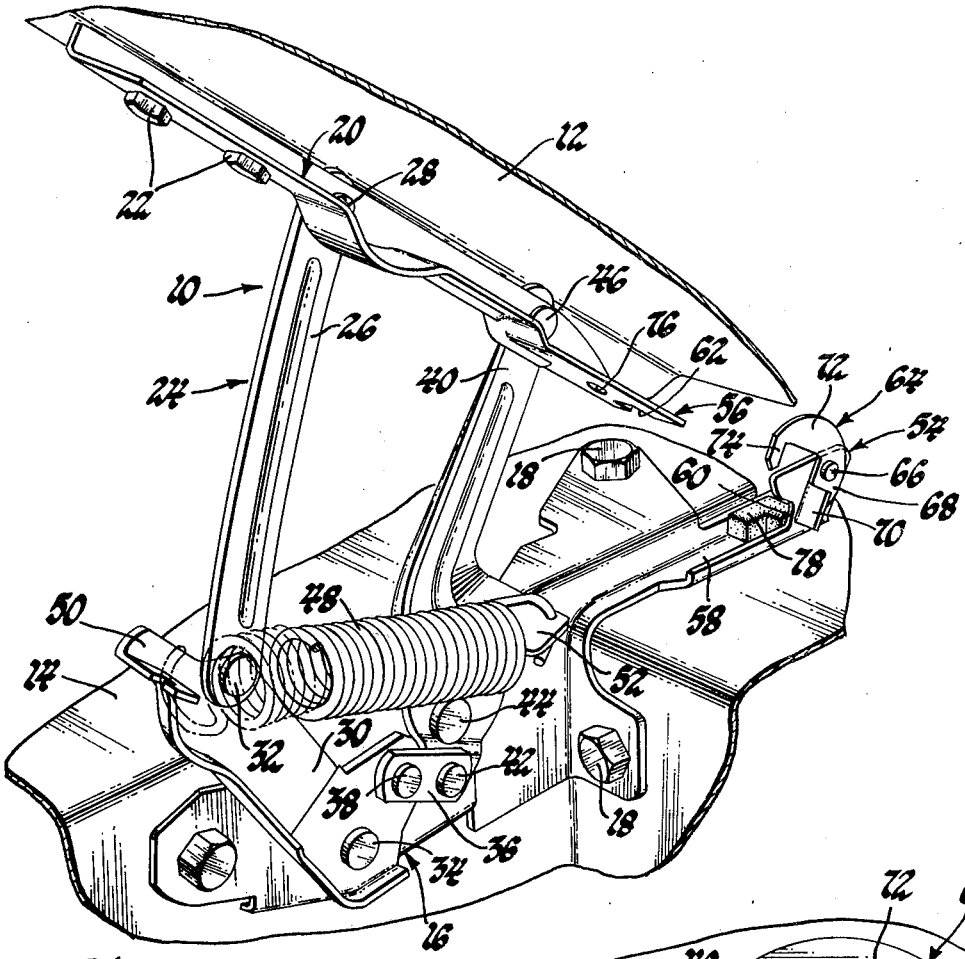
FIG. 1 is a fragmentary perspective view of a vehicle body hood hinge embodying the invention, with the body and hood hinge portions of the hinge shown in a hood open position.

Referring now to the drawings in greater detail, FIG. 1 illustrates a vehicle body hood hinge 10, adapted to support the rear end of a hood 12 on a vehicle body 14 adjacent the rear end of a forward engine compartment of the vehicle. One such hinge is used at each lateral side of the rear end of the hood, the hinges differing only in being symmetrical about the centerline of the vehicle, and the hood is thereby supported for movement between open and closed positions. The hinge 10 includes a body hinge member 16 secured to the body 14 by bolts 18 and a hood hinge member 20 secured to the hood 12 by bolts 22. The body and hood hinge members 16 and 20, respectively, are interconnected for movement relative to each other by conventional linkage, indicated generally by 24. The linkage 24 includes an elongated link 26 whose upper end is pivotally connected to the forward end of the hood hinge member 20 by a pin 28. The lower end of the link 26 is pivotally connected to the longer leg of a somewhat L-shaped link 30 by a pin 32. The link 30 is pivotally connected to the body hinge member 16 at the juncture of its legs by a pin 34. The shorter leg of the link 30 is pivotally connected to one end of a control link 36 by a pin 38. The other end of the control link 36 is pivotally connected to one end-portion of a link 40 by a pin 42. The one end-portion of the link 40 is also pivotally connected to the body hinge member 16 by a pin 44, and the other end thereof is pivotally connected to the hood hinge member 20 by a pin 46 rearward of the pin 28.

A helical spring 48 extends between an attachment flange 50 formed on the link 30 and an attachment flange 52 formed on the link 40 so as to selectively and alternately bias the hinge 10 to either the open position that is shown, or to the closed position where the hood 12 closes the engine compartment of the vehicle body 14. During closing movement of the hood 12, the link 40 pivots rearwardly about the pin 44, clockwise as viewed in FIG. 1, and thereby moves the rear end of the hood hinge member 20 in a downward and rearward direction. The L-shaped link 30 pivots counterclockwise during this same movement and shifts the lower end of the link 26 downwardly and forwardly. The upper end of the link 26 thus moves downwardly so that the pin 28 pulls the forward end of the hood hinge member 20 downwardly. The control link 36 coordinates the movement of the links 30 and 40 during this closing movement, as well as during opening movement. The centerline of the spring 48 moves below the axis of the pin 44 during the closing movement of the hinge 10, and thereafter biases the hinge to its hood closed position. Opening movement of the hinge 10 moves the links 30 and 40 in the opposite directions to that of the closing movement, so that the centerline of the spring 48 moves above the pin 44, the spring action thus serving to urge the hinge 10 to its open position.

Adjacent the rear end of the hinge 10, the body and hood hinge members 16 and 20, respectively, include generally planar flanges 54 and 56. The flange 54 of the body hinge member 16 is bent upwardly from a rearward horizontal portion 58 of the body hinge member so as to be located in a vertical plane, and has a generally hook-shaped configuration that defines a forwardly facing opening or notch 60. The rear end of the hood hinge member 20 defines a rearwardly facing opening or slot 62 that is somewhat elongated.

A lock arm 64 is pivotally mounted by a suitable pin 66 on the flange 54. The lock arm 64 is formed to include a strikerend 68 having a laterally extending striker plate 70 formed on the forward edge thereof, and a pawl-end 72 having a generally downwardly extending locking pawl 74 formed on its forward edge. An aperture 76 is formed in the hood hinge flange 56 just forward of the elongated slot 62.

Figure 2:
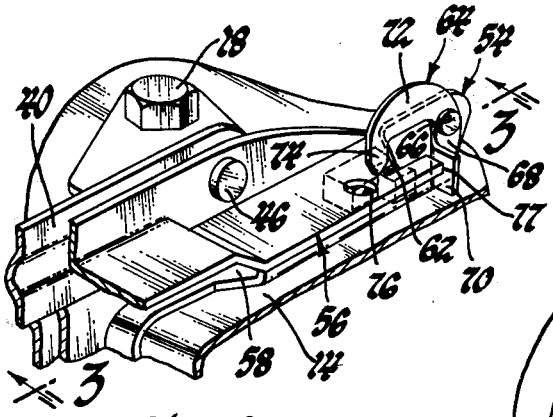
FIG. 2 is a fragmentary perspective view of a portion of the FIG. 1 hinge structure shown in a hood closed position.
Figure 3:
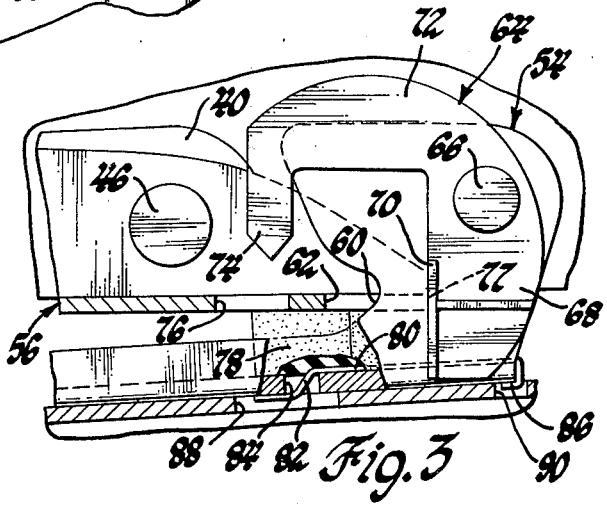
FIG. 3 is an enlarged sectional view of the hinge taken along the plane of line 3-3 of FIG. 2, and looking in the direction of the arrows.

As the hinge 10 is moved to its closed position, the flange 56 moves rearwardly to a horizontal orientation and into an inter-received relationship with the flange 54, so that the notch 60 receives the flange 56 and the slot 62 receives the flange 54 in the manner shown in FIG. 2. At the same time, the rear edge 77 of the flange 56 abuts against the striker plate 70, pivoting the striker-end 68 about the pin 66 a predetermined amount until the locking pawl 74 is positioned adjacent and substantially directly above the aperture 76, as shown in FIG. 3.

Figure 4:
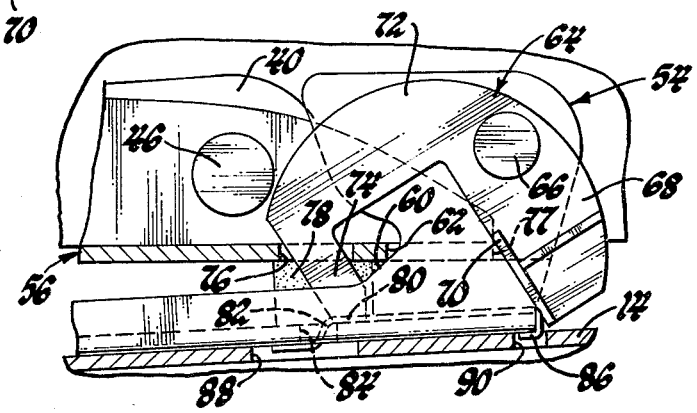
FIG. 4 is a view showing the FIG. 3 components in a different operative position.

Should impact forces associated with a frontal vehicle impact attempt to move the rear end of the hood 12 vertically or rearwardly while the respective body and hood hinge flanges 54 and 56 are in their inter-received relationship, engagement of the end wall of the slot 62 in the flange 56 and the surface of the flange 54 defining the notch 60 will serve to limit such movement. Likewise, engagement between the sides of the flange 54 and the opposed side walls of the slot 62 in the flange 56 serves to limit any attempted lateral movement of the rear end of the hood 12 under similar conditions. Additionally, in such an impact condition, the rear edge 77 of the hood hinge flange 56 will pivot the striker-end 68 of the lock arm 64 rearwardly, i.e., in a counterclockwise direction (FIG. 4) about the pin 66, forcing the locking pawl 74 downwardly through the aperture 76, thereby serving to help limit vertical and rearward movement of the hood 12 during such impact, and to prevent rebounding of the hood hinge flange 56 off the body hinge flange 54 upon relaxation of the impact loads.

A rubber member or stop 78 is mounted on the rearward horizontal portion 58 of the body hinge member 16. A metal insert or strap 80 (FIG. 3) is molded within the rubber stop 78 and has a forward end 82 inserted downwardly through an aperture 84 formed in the horizontal portion 58 of the body hinge member 16 and bent forward below the front end of the aperture 84 to secure the end 82 of the strap 80. The rear end 86 of the metal strap 80 extends around the rear end of the horizontal portion 58 of the body hinge member 16 to secure the end 86 of the strap 80 to the body hinge member 16. The strap 80 thus secures the stop 78 in the position shown on the body hinge member 16. Suitable apertures 88 and 90 formed in the portion of the vehicle body 14 adjacent the stop 78 receive the respective bent ends 82 and 86 of the metal strap 80 so that a flush mounting is provided. When the hinge 10 is in the hood closed position, the stop 78 engages the hood hinge flange 56 at the rear end of the hood hinge member 20 to resiliently position the flanges 54 and 56 with respect to each other. It is, of course, possible for the stop 78 to be mounted in a reverse manner on the hood hinge member 20 and to engage the body hinge member 16 adjacent the flange 54 to provide a similar resilient positioning of these flanges 54 and 56 with respect to each other.

It is thus apparent from the foregoing description that this invention provides a simple and effective means for limiting forced vertical, lateral, and rearward movement of the rear end of an engine compartment hood during impact conditions, and for preventing rebounding of the hood flange portion of the hinge off the cooperating body flange portion of the hinge upon relaxation of the impact loads.

While but one embodiment of the invention has been shown and described, other modifications thereof are possible.

I claim:

1. A vehicle body hood hinge comprising a body hinge member adapted to be mounted on a vehicle body adjacent the rear end of a forward engine compartment thereof, a hood hinge member adapted to be mounted on the rear end of a hood for closing the upper side of the engine compartment, means connecting the body and hood hinge members for movement relative to each other between hood open and closed positions, the hood hinge member including a generally planar flange defining a rearwardly opening slot and having an aperture formed therein adjacent said slot, the body hinge member including a generally planar flange oriented in a generally vertical plane and defining a forwardly opening notch, and a lock arm pivotally mounted on the body hinge member and including a striker end and a pawl end, movement of the hinge members to closed position moving the hood hinge flange to a generally horizontal orientation and the flanges into an interreceived relationship wherein the notch receives the hood hinge flange, the slot receives the body hinge flange, and the aperture receives the pawl end only in the event of an impact causing the hood hinge flange to pivot the striker end rearwardly and the pawl end downwardly into the aperture, thereby limiting forced vertical, lateral, and rearward movement of the rear end of the hood with respect to the vehicle body.

2. A vehicle body hood hinge comprising a body hinge member adapted to be mounted on a vehicle body adjacent the rear end of a forward engine compartment thereof, a hood hinge member adapted to be mounted on the rear end of a hood for closing the upper side of the engine compartment, means connecting the body and hood hinge members for movement relative to each other between hood open and closed positions, the hood hinge member including a generally planar flange defining a rearwardly opening slot and having an aperture formed therein adjacent said slot, the body hinge member including a generally planar flange oriented in a generally vertical plane and defining a forwardly opening notch, and a lock arm pivotally mounted on a pin on the body hinge member and including a striker end having a laterally extending striker plate formed thereon, and a pawl end having a generally downwardly extending locking pawl formed thereon, movement of the hinge members to closed position moving the hood hinge flange to a generally horizontal orientation and the flanges into an interreceived relationship wherein the notch receives the hood hinge flange, the slot receives the body hinge flange, and the aperture receives the locking pawl only in the event of an impact causing the hood hinge flange to urge the striker plate rearwardly and thereby pivoting the striker end and the pawl end about the pin so as to move the pawl end downwardly into the aperture, thereby limiting forced vertical, lateral, and rearward movement of the rear end of the hood with respect to the vehicle body during said impact, and further limiting rebounding of the hood hinge flange off the body hinge flange upon relaxation of the impact loads.

3. A vehicle body hood hinge comprising a body hinge member adapted to be mounted on a vehicle body adjacent the rear end of a forward engine compartment thereof, a hood hinge member adapted to be mounted on the rear end of a hood for closing the upper side of the engine compartment, means connecting the body and hood hinge members for movement relative to each other between hood open and closed positions, the hood hinge member including a generally planar flange defining a rearwardly opening slot and having an aperture formed therein adjacent said slot, the body hinge member including a generally planar flange oriented in a generally vertical plane and defining a forwardly opening notch, a lock arm pivotally mounted on a pin on the body hinge member and including a striker end having a laterally extending striker plate formed thereon, and a pawl end having a generally downwardly extending locking pawl formed thereon, movement of the hinge members to closed position moving the hood hinge flange to a generally horizontal orientation and the flanges into an interreceived relationship wherein the notch receives the hood hinge flange, the slot receives the body hinge flange, and the aperture receives the locking pawl only in the event of an impact causing the hood hinge flange to urge the striker plate rearwardly and thereby pivoting the striker end and the pawl end about the pin so as to move the pawl end downwardly into the aperture, thereby limiting forced vertical, lateral, and rearward movement of the rear end of the hood with respect to the vehicle body during said impact, and further limiting rebounding of the hood hinge flange off the body hinge flange upon relaxation of the impact loads, and a resilient member mounted on one of the hinge members adjacent the flange thereof and engaging the other hinge member adjacent the flange thereof when the hinge members are in closed position so as to resiliently position these flanges with respect to each other.

* * * * *

UNITED STATES PATENT AND TRADEMARK OFFICE

CERTIFICATE OF CORRECTION

PATENT NO. : 4,012,807

DATED : March 22, 1977

INVENTOR(S) : Otto A. Kern

It is certified that error appears in the above-identified patent and that said Letters Patent are hereby corrected as shown below:

Column 1, line 8 "designated" should read -- designed --.

Column 1, line 14, "Parter" should read -- Porter --.

Signed and Sealed this second Day of August 1977

[SEAL]

*Attest:*

RUTH C. MASON
*Attesting Officer*

C. MARSHALL DANN
*Commissioner of Patents and Trademarks*